US011685968B2

(12) United States Patent
Li et al.

(10) Patent No.: US 11,685,968 B2
(45) Date of Patent: Jun. 27, 2023

(54) NANO DISPERSION COPPER ALLOY WITH HIGH AIR-TIGHTNESS AND LOW FREE OXYGEN CONTENT AND BRIEF MANUFACTURING PROCESS THEREOF

(71) Applicant: CENTRAL SOUTH UNIVERSITY, Hunan (CN)

(72) Inventors: Zhou Li, Hunan (CN); Wenting Qiu, Hunan (CN); Zhu Xiao, Hunan (CN); Shen Gong, Hunan (CN)

(73) Assignee: CENTRAL SOUTH UNIVERSITY, Changsha (CN)

( * ) Notice: Subject to any disclaimer, the term of this patent is extended or adjusted under 35 U.S.C. 154(b) by 486 days.

(21) Appl. No.: 16/627,979

(22) PCT Filed: Mar. 15, 2019

(86) PCT No.: PCT/CN2019/078199

§ 371 (c)(1),
(2) Date: Dec. 31, 2019

(87) PCT Pub. No.: WO2020/155322

PCT Pub. Date: Aug. 6, 2020

(65) Prior Publication Data

US 2021/0363610 A1 Nov. 25, 2021

(30) Foreign Application Priority Data

Jan. 29, 2019 (CN) ..... 201910088573.7

(51) Int. Cl.

| | |
|---|---|
| ***C22C 1/04*** | (2023.01) |
| ***B22F 9/04*** | (2006.01) |
| ***B22F 9/22*** | (2006.01) |
| ***C22C 1/05*** | (2023.01) |
| ***C22C 9/00*** | (2006.01) |
| ***C22C 32/00*** | (2006.01) |
| ***B22F 3/17*** | (2006.01) |
| ***B22F 3/20*** | (2006.01) |
| ***B22F 9/08*** | (2006.01) |

(52) U.S. Cl.

CPC ..... *C22C 1/0425* (2013.01); *B22F 3/172* (2013.01); *B22F 3/20* (2013.01); *B22F 9/04* (2013.01); *B22F 9/082* (2013.01); *B22F 9/22* (2013.01); *C22C 1/05* (2013.01); *C22C 9/00* (2013.01); *C22C 32/0021* (2013.01); *B22F 2009/043* (2013.01); *B22F 2301/10* (2013.01); *B22F 2302/253* (2013.01)

(58) Field of Classification Search

CPC ..... C22C 1/05

See application file for complete search history.

(56) References Cited

U.S. PATENT DOCUMENTS

2003/0095887 A1* 5/2003 Dong ..... C22C 9/04 420/470

FOREIGN PATENT DOCUMENTS

| | | | |
|---|---|---|---|
| CN | 101121974 | A | 2/2008 |
| CN | 101240387 | A | 8/2008 |
| CN | 101250639 | A | 8/2008 |
| CN | 101586198 | A | 11/2009 |
| CN | 104164587 | A | 11/2014 |
| CN | 105772737 | A | 7/2016 |
| CN | 109207766 | A | 1/2019 |
| EP | 0364295 | A2 | 4/1990 |
| JP | 06228681 | A | 8/1994 |
| JP | H06228681 | A | 8/1994 |

OTHER PUBLICATIONS

International Search Report, corresponding to Application No. PCT/CN2019/078199; dated Oct. 24, 2019.

State Intellectual Property Office of People's Republic of China, First Search, corresponding to CN Application No. 2019100885737.

* cited by examiner

*Primary Examiner* — Christopher S Kessler

(74) *Attorney, Agent, or Firm* — Lippes Mathias LLP

(57) ABSTRACT

Disclosed is a nano dispersion copper alloy with high air-tightness and low free oxygen content and a brief manufacturing process thereof, wherein alloy comprises the following components: $Al_2O_3$, Ca and La. The manufacturing process comprises the following steps of: preparing Cu—$Al_2O_3$ alloy powder by an internal oxidation method; mixing the Cu—$Al_2O_3$ alloy powder with Cu—Ca—La alloy powder; sheathing the mixed powder under protection of argon; performing hot extrusion and then rotary forging; vacuumizing the sheath after the rotary forging; and sealing and placing the sheath in a nitrogen atmosphere with a temperature of 450° C. to 550° C. and a pressure intensity of 40 Mpa to 60 Mpa for 3 hours to 5 hours. The dispersion copper prepared by the present disclosure has the advantages of low free oxygen content (≤15 ppm), high dimensional stability, good air-tightness and an air leakage rate≤$1.0\times10^{-10}$ Pa $m^3$/s after hydrogen annealing.

10 Claims, No Drawings

NANO DISPERSION COPPER ALLOY WITH HIGH AIR-TIGHTNESS AND LOW FREE OXYGEN CONTENT AND BRIEF MANUFACTURING PROCESS THEREOF

FIELD OF THE INVENTION

The present disclosure relates to a nano dispersion copper alloy with high air-tightness and low free oxygen content and a brief manufacturing process thereof, and more particularly, relates to a Cu—$Al_2O_3$—CaO—$La_2O_3$ nano-sized dispersion copper alloy with high air-tightness and low free oxygen content and a brief manufacturing process thereof. The present disclosure belongs to the field of manufacturing process of a nano dispersion copper alloy.

BACKGROUND OF THE INVENTION

A nano dispersion strengthened copper alloy is a novel structural functional material with excellent comprehensive physical and mechanical properties, and also has high strength, high conductivity and good high-temperature softening resistance.

In the prior art, a Cu—$Al_2O_3$ nano dispersion strengthened copper alloy is mainly prepared by an internal oxidation method, and a specific manufacturing process is as follows: after smelting a Cu—Al alloy having appropriate components, gas atomization and powder spraying are performed, then the powder is mixed with an appropriate amount of oxidant, the mixture is heated in a sealed container for internal oxidation, a solute element Al is preferentially oxidized by oxygen diffused and infiltrated on a surface to generate $Al_2O_3$, then composite powder is reduced in hydrogen, residual $Cu_2O$ is removed, and then the powder is sheathed, vacuumized, extruded or hot-forged to form into shape. At present, the Cu—$Al_2O_3$ dispersion strengthened copper alloy prepared by the above process in China has a room temperature tensile strength ranging from 246 MPa to 405 MPa and an electric conductivity ranging from 83.4 IACS to 92.9 IACS after hydrogen annealing at 900° C. for 1 hour. However, a part of oxygen diffused into a copper matrix is difficult to be completely removed by hydrogen reduction, and due to the incongruity deformations of $Al_2O_3$ and Cu, micropores are easily generated during hot extrusion and subsequent cold working. Therefore, the Cu—$Al_2O_3$ nano dispersion copper alloy prepared by the internal oxidation method used in the prior art still has the problems of high residual free oxygen content and low air-tightness.

With rapid development of aerospace, electronic communication and other fields, a higher demand is put forward for the "quality" of dispersion oxygen-free copper with high conductivity and heat resistance. In addition to the high heat resistance, high strength and high conductivity, the dispersion copper is required to have low amount of residual free oxygen and high air-tightness. If 100 ppm oxygen is contained in 100 g copper, 14 $cm^3$ high-pressure water vapor can be generated during hydrogen annealing at 900° C. to crack the copper and reduce the air-tightness. At present, a free oxygen content of the Cu—$Al_2O_3$ dispersion strengthened copper alloy prepared in China is more than 56.1 ppm, and a diameter expansion of ordinary Cu—$Al_2O_3$ dispersion strengthened copper alloy of Φ24 mm before and after hydrogen burning at 900° C. for 1 hour is more than 0.01 mm. If a residual free oxygen content in dispersion copper is high, free oxygen is slowly released under a high-vacuum condition, poisoning a cathode and causing device failure.

At present, the brief manufacturing process of the internal oxidation method for the Cu—$Al_2O_3$ nano dispersion copper alloy with high air-tightness and low free oxygen content has not been publicly reported.

SUMMARY OF THE INVENTION

The purpose of the present disclosure is to overcome the problems of high residual free oxygen content and low air-tightness in existing Cu—$Al_2O_3$ nano dispersion copper alloy prepared by internal oxidation, and provide a nano dispersion copper alloy with high air-tightness and low free oxygen content and a brief manufacturing process thereof.

According to the present disclosure, a gas-solid secondary reduction is utilized to reduce a residual free oxygen content, and an alloy is further densified through vacuum medium-temperature creep deformation to finally obtain a Cu—$Al_2O_3$—CaO—$La_2O_3$ nano dispersion copper alloy with low oxygen, high air-tightness, high strength and high conductivity.

According to the present disclosure, a nano dispersion copper alloy with high air-tightness and low free oxygen content, comprising the following components in percentage by mass:

0.05 wt. % to 1.61 wt. % of $Al_2O_3$, 0.008 wt. % to 0.012 wt. % of Ca, and 0.008 wt. % to 0.012 wt. % of La, and the balance of Cu.

According to the present disclosure, a brief manufacturing process of a nano dispersion copper alloy with high air-tightness and low free oxygen content, comprising the following steps of: preparing Cu—$Al_2O_3$ alloy powder by an internal oxidation method; mixing the Cu—$Al_2O_3$ alloy powder with Cu—Ca—La alloy powder; sheathing the mixed powder under protection of argon; performing hot extrusion at 900° C. to 920° C. and then rotary forging; vacuumizing the sheath to be less than or equal to $10^{-3}$ Pa after the rotary forging; and sealing and placing the sheath in a nitrogen atmosphere with a temperature ranging from 450° C. to 550° C. and a pressure intensity ranging from 40 Mpa to 60 Mpa for 3 hours to 5 hours.

According to the brief manufacturing process of the nano dispersion copper alloy with high air-tightness and low free oxygen content of the present disclosure, the internal oxidation method for preparing the Cu—$Al_2O_3$ alloy powder comprises the following steps of:

first step: powder preparation smelting Al and Cu to prepare a Cu—Al alloy melt with an Al content of 0.03 wt. % to 0.8 wt. %, and atomizing the melt to prepare powder;

second step: ball-milling activation mixing the powder prepared in the first step with an oxidant for ball-milling activation;

third step: graded internal oxidation performing two-grade internal oxidation on the mixture obtained in the second step at 380° C. to 400° C. and 880° C. to 900° C. in a protective atmosphere; and fourth step: reduction crushing the internally oxidized powder obtained in the third step and then reducing with hydrogen to obtain the Cu—$Al_2O_3$ alloy powder.

According to the brief manufacturing process of the nano dispersion copper alloy with high air-tightness and low free oxygen content of the present disclosure, in the first step of the internal oxidation method for preparing the Cu—$Al_2O_3$ alloy powder, a smelting temperature of the alloy is 1200° C.

to 1230° C.; and the alloy melt is pulverized by pure nitrogen atomization, and a purity of nitrogen is more than or equal to 99.9%.

According to the brief manufacturing process of the nano dispersion copper alloy with high air-tightness and low free oxygen content of the present disclosure, in the second step of the internal oxidation method for preparing the Cu—$Al_2O_3$ alloy powder, alloy powder with a particle diameter less than 40 meshes is mixed with the oxidant for ball-milling; an addition amount of the oxidant accounts for 0.5 wt % to 9.5 wt % of a mass of the alloy powder, and a main component of the oxidant is $Cu_2O$.

According to the brief manufacturing process of the nano dispersion copper alloy with high air-tightness and low free oxygen content of the present disclosure, in the second step of the internal oxidation method for preparing the Cu—$Al_2O_3$ alloy powder, a ball-milling process is as follows: a ratio of ball and material is 3:1 to 10:1, a rotating speed is 50 rpm to 300 rpm, a ball milling time is 120 minutes to 600 minutes, and an atmosphere is air.

According to the brief manufacturing process of the nano dispersion copper alloy with high air-tightness and low free oxygen content of the present disclosure, in the third step of the internal oxidation method for preparing the Cu—$Al_2O_3$ alloy powder, the parameters of internal oxidation process are as follows: the ball-milled powder is heated to 380° C. to 400° C. in an argon or nitrogen atmosphere and held for 2 hours to 4 hours, and then the ball-milled powder is continuously heated to 880° C. to 900° C. and held for 2 hours to 4 hours.

According to the brief manufacturing process of the nano dispersion copper alloy with high air-tightness and low free oxygen content of the present disclosure, in the fourth step of the internal oxidation method for preparing the Cu—$Al_2O_3$ alloy powder, the internally oxidized powder is sieved through a 40-mesh sieve after crushing, and the sieved powder is heated to 880° C. to 900° C. and reduced by hydrogen for 4 hours to 8 hours.

According to the brief manufacturing process of the nano dispersion copper alloy with high air-tightness and low free oxygen content of the present disclosure, the preparation method of Cu—Ca—La alloy powder comprises the following steps of:

heating and smelting Cu, Cu—Ca intermediate alloy and La to prepare a Cu—Ca—La alloy melt with a Ca content of 0.08 wt. % to 0.12 wt. % and a La content of 0.08 wt. % to 0.12 wt. %; atomizing the melt with high-purity nitrogen to prepare powder; sieving the powder with a 200-mesh sieve; and performing ball-milling on the sieved powder until a particle diameter of the powder is less than 20 microns to obtain superfine powder; wherein a purity of the high-purity nitrogen is more than or equal to 99.9%.

According to the brief manufacturing process of the nano dispersion copper alloy with high air-tightness and low free oxygen content of the present disclosure, the Cu—Ca—La alloy powder and the Cu—$Al_2O_3$ alloy powder prepared by the internal oxidation method are mixed according to a mass ratio ranging from 1:10 to 1:15, subjected to cold isostatic pressing, sheathed by pure copper in an argon chamber, subjected to water sealing and hot extrusion at 900° C. to 920° C., with an extrusion ratio greater than or equal to 15, then subjected to rotary forging after extrusion; a rotationally forged bar is placed in a new sheath, then the sheath is vacuumized to $10^{-3}$ Pa, sealed, and placed in a nitrogen atmosphere with a pressure intensity ranging from 40 Mpa to 60 Mpa at 450° C. to 550° C. for 3 hours to 5 hours.

According to the brief manufacturing process of the nano dispersion copper alloy with high air-tightness and low free oxygen content of the present disclosure, the prepared nano dispersion copper alloy has a tensile strength of 330 MPa to 580 MPa at room temperature, an electric conductivity greater than 80%-97% IACS, a free oxygen content less than or equal to 15 ppm, and an air leakage rate less than or equal to $1.0\times10^{-10}$ Pa $m^3$/s.

According to the brief manufacturing process of the nano dispersion copper alloy with high air-tightness and low free oxygen content of the present disclosure, the diameter of the prepared nano dispersion copper alloy of ϕ20 mm is changed by 0.00 μm before and after annealing with hydrogen at 900° C. for 1 hour through measurement by a spiral micrometer. The present disclosure has the following advantages.

According to the present disclosure, aiming at the problems of high free oxygen content and low air-tightness of the Cu—$Al_2O_3$ nano dispersion copper alloy in China at present, a gas-solid secondary reduction technology is added in the traditional internal oxidation technology, and in combination with a synergistic effect of a vacuum medium-temperature creep deformation technology, the Cu—$Al_2O_3$—CaO—$La_2O_3$ nano dispersion copper alloy with low oxygen, high density, high strength and high conductivity is prepared.

The gas-solid secondary reduction technology refers to that, on the basis of performing traditional hydrogen reduction on the internally oxidized powder, that is, gaseous reduction, a solid reduction technology is added, that is, a proper amount of Cu-0.1 wt % Ca-0.1 wt % La alloy powder is added to the reduced Cu—$Al_2O_3$ powder. A characteristic that Ca and La react easily with oxygen is utilized, adding the two elements to the alloy can significantly reduce the free oxygen content in the alloy, and nano-sized CaO and $La_2O_3$ can also play a role in dispersion strengthening of the alloy. The vacuum medium-temperature creep deformation refers to that the rotationally forged bar is placed in the sheath, and then the sheath is vacuumized, sealed and placed in the nitrogen atmosphere with the pressure ranging from 40 Mpa to 60 Mpa at 450° C. to 550° C. for heat preservation and pressure treatment for 3 hours to 5 hours to cause creep deformation of the alloy, thus eliminating micropores and microcracks generated inside the alloy during preparation and processing, and improving the density of the alloy.

According to the present disclosure, +Ca hydrogen primary reduction and La solid secondary reduction technologies are adopted, so that the prepared alloy has low residual oxygen, and meanwhile, the nano-sized CaO and $La_2O_3$ can also play a role in dispersion strengthening.

Due to the incongruity deformations of $Al_2O_3$ and Cu, micropores are easily generated during hot extrusion and subsequent cold working, thus affecting the density. Through rotary forging deformation, a pressure stress is applied to an extruded material, so that a part of $Al_2O_3$ at grain boundaries can enter the copper matrix to weld a part of holes; a rotationally forged material is placed in the sheath, then the sheath is vacuumized and maintained in the nitrogen atmosphere with the pressure ranging from 40 Mpa to 60 Mpa at 450° C. to 550° C. for 3 hours to 5 hours. The microcracks are healed through creep deformation, so that the density and the air tightness of the alloy are improved.

The dispersion copper prepared by the present disclosure has the advantages of low free oxygen content of less than or equal to 15 ppm, high dimensional stability, good air tightness, and an air leakage rate less than or equal to $1.0\times10^{-10}$ Pa $m^3$/s after hydrogen annealing. The dispersion copper is suitable for industrial production. In addition, the material made from the dispersion copper can be used as a variety of sealing device materials, such as an electric vacuum shell sealing device and a high-voltage direct-current relay for a novel energy automobile.

DETAILED DESCRIPTION OF THE EMBODIMENTS

Embodiment 1

A Cu-0.1 wt % Ca-0.1 wt % La alloy was smelted under inert gas protection at 1200° C., atomized with high-purity nitrogen, sieved, and then subjected to high-energy ball milling to obtain superfine powder (an average particle diameter was less than or equal to 20 microns). Al and Cu were smelted at 1218° C. to 1230° C. to obtain a Cu—Al alloy with an Al content of 0.04 wt %. The Cu—Al alloy was atomized with high-purity nitrogen, and sieved to obtain alloy powder with a particle diameter less than 40 meshes. The alloy powder was mixed with an oxidant, subjected to ball milling, internally oxidized with the oxidant at 386° C. to 395° C. for 2 hours, and then internally oxidized at 892° C. to 900° C. for 3 hours. The internally oxidized powder above was crushed, reduced with hydrogen at 885° C. to 893° C. for 6 hours, mixed with Cu—Ca—La alloy superfine powder according to a ratio of 15:1. The mixed powder above was subjected to cold isostatic pressing, sheathed by pure copper in an argon chamber, and subjected to water sealing and hot extrusion at 900° C., with an extrusion ratio of 15:1, and then subjected to rotary forging after extrusion. The rotationally forged bar was placed in a new sheath, then the sheath was vacuumized to $10^{-3}$ Pa, sealed and placed in a nitrogen atmosphere with a pressure of 40 Mpa at 480° C. for 3 hours. A free oxygen content was less than or equal to 11 ppm (the free oxygen content was detected by a nitrogen/oxygen analyzer TC-436 manufactured by LECO Company of the United States), and properties of the alloy were shown in Table 1.

TABLE 1

Yield Strength, Tensile Strength, Elongation and Electric Conductivity at Different Test Temperatures

| Yield strength (MPa) | Tensile strength (MPa) | Percentage reduction of area A (%) | Electric conductivity (% IACS) | Air leakage rate (Pa $m^3$/s) |
|---|---|---|---|---|
| 325 | 345 | 13.6 | 96.2 | $3.2 \times 10^{-11}$ |

Embodiment 2

A Cu-0.1 wt % Ca-0.1 wt % La alloy was smelted under inert gas protection at 1200° C., atomized with high-purity nitrogen, sieved, and then subjected to high-energy ball milling to obtain superfine powder (an average particle diameter was less than or equal to 20 microns). Al and Cu were smelted at 1200° C. to 1222° C. to obtain a Cu—Al alloy with an Al content of 0.12 wt %. The Cu—Al alloy was atomized with high-purity nitrogen, and sieved to obtain alloy powder with a particle diameter less than 40 meshes. The alloy powder was mixed with an oxidant, subjected to ball milling, internally oxidized with the oxidant at 392° C. to 400° C. for 2 hours, and then internally oxidized at 893° C. to 898° C. for 3 hours. The internally oxidized powder above was crushed, reduced with hydrogen at 895° C. to 900° C. for 6 hours, mixed with Cu—Ca—La alloy superfine powder according to a ratio of 13:1. The mixed powder above was subjected to cold isostatic pressing, sheathed by pure copper in an argon chamber, and subjected to water sealing and hot extrusion at 900° C., with an extrusion ratio of 15:1, and then subjected to rotary forging after extrusion. The rotationally forged bar was placed in a new sheath, then the sheath was vacuumized to $10^{-3}$ Pa, sealed, and placed in a nitrogen atmosphere with a pressure of 50 Mpa at 500° C. for 3 hours. A free oxygen content was less than or equal to 12 ppm (the free oxygen content was detected by a nitrogen/oxygen analyzer TC-436 manufactured by LECO Company of the United States), and properties of the alloy were shown in Table 2.

TABLE 2

Yield Strength, Tensile Strength, Elongation, Electric Conductivity and Air Leakage Rate

| Yield strength (MPa) | Tensile strength (MPa) | Percentage reduction of area A (%) | Electric conductivity (% IACS) | Air leakage rate (Pa $m^3$/s) |
|---|---|---|---|---|
| 345 | 376 | 12.5 | 92.2 | $5.1 \times 10^{-11}$ |

Embodiment 3

A Cu-0.1 wt % Ca-0.1 wt % La alloy was smelted under inert gas protection at 1200° C., atomized with high-purity nitrogen, sieved, and then subjected to high-energy ball milling to obtain superfine powder (an average particle diameter was less than or equal to 20 microns). Al and Cu were smelted at 1215° C. to 1230° C. to obtain a Cu—Al alloy with an Al content of 0.30 wt %. The Cu—Al alloy was atomized with high-purity nitrogen, and sieved to obtain alloy powder with a particle diameter less than 40 meshes. The alloy powder was mixed with an oxidant, subjected to ball milling, internally oxidized with the oxidant at 382° C. to 393° C. for 2 hours, and then internally oxidized at 887° C. to 896° C. for 3 hours. The internally oxidized powder above was crushed, reduced with hydrogen at 892° C. to 898° C. for 6 hours, mixed with Cu—Ca—La alloy superfine powder according to a ratio of 10:1. The mixed powder above was subjected to cold isostatic pressing, sheathed by pure copper in an argon chamber, and subjected to water sealing and hot extrusion at 900° C., with an extrusion ratio of 15:1, and then subjected to rotary forging after extrusion. The rotationally forged bar was placed in a new sheath, then the sheath was vacuumized to $10^{-3}$ Pa, sealed, and placed in a nitrogen atmosphere with a pressure of 50 Mpa at 520° C. for 3 hours. A free oxygen content was less than or equal to 12 ppm (the free oxygen content was detected by a nitrogen/oxygen analyzer TC-436 manufactured by LECO Company of the United States), and properties of the alloy were shown in Table 3.

TABLE 3

Yield Strength, Tensile Strength, Elongation and Electric Conductivity

| Yield strength (MPa) | Tensile strength (MPa) | Percentage reduction of area A (%) | Electric conductivity (% IACS) | Air leakage rate (Pa $m^3$/s) |
|---|---|---|---|---|
| 490 | 520 | 12.5 | 87.8 | $8.7 \times 10^{-11}$ |

Embodiment 4

A Cu-0.1 wt % Ca-0.1 wt % La alloy was smelted under inert gas protection at 1200° C., atomized with high-purity nitrogen, sieved, and then subjected to high-energy ball milling to obtain superfine powder (an average particle diameter was less than or equal to 20 microns). Al and Cu were smelted at 1215° C. to 1228° C. to obtain a Cu—Al alloy with an Al content of 0.8 wt %. The Cu—Al alloy was atomized with high-purity nitrogen, and sieved to obtain alloy powder with a particle diameter less than 40 meshes. The alloy powder was mixed with an oxidant, subjected to ball milling, internally oxidized with the oxidant at 388° C. to 400° C. for 2 hours, and then internally oxidized at 886° C. to 894° C. for 3 hours. The internally oxidized powder above was crushed, reduced with hydrogen at 885° C. to 893° C. for 6 hours, mixed with Cu—Ca—La alloy superfine powder according to a ratio of 15:1. The mixed powder above was subjected to cold isostatic pressing, sheathed by pure copper in an argon chamber, and subjected to water sealing and hot extrusion at 900° C., with an extrusion ratio of 15:1, and then subjected to rotary forging after extrusion. The rotationally forged bar was placed in a new sheath, then the sheath was vacuumized to $10^{-3}$ Pa, sealed, and placed in a nitrogen atmosphere with a pressure of 60 Mpa at 550° C. for 3 hours. A free oxygen content was less than or equal to 14 ppm (the free oxygen content was detected by a nitrogen/oxygen analyzer TC-436 manufactured by LECO Company of the United States), and properties of the alloy were shown in Table 4.

TABLE 4

Tensile Strength, Elongation, Electric Conductivity and Yield Strength at Different Test Temperatures

| Test temperature (° C.) | Tensile strength (MPa) | Elongation (%) | Electric conductivity (% IACS) | Air leakage rate (Pa $m^3$/s) |
|---|---|---|---|---|
| 25 | 568 | 9.7 | 80.0 | $9.6 \times 10^{-11}$ |
| 700 | 261 | 7.1 | / | |

What is claimed is:

1. A brief manufacturing process of a nano dispersion copper alloy, comprising the steps of:

preparing Cu—$Al_2O_3$ alloy powder by an internal oxidation method;

mixing the Cu—$Al_2O_3$ alloy powder with Cu—Ca—La alloy powder;

sheathing the mixed powder under protection of argon to obtain a sheath;

performing hot extrusion on the sheath at 900° C. to 920° C. to obtain an extruded sheath;

performing rotary forging on the extruded sheath to obtain a rotationally forged bar;

placing the rotationally forged bar in a new sheath;

vacuumizing the new sheath to be less than or equal to $10^{-3}$ Pa;

sealing the new sheath to obtain a new sealed sheath; and placing the new sealed sheath in a nitrogen atmosphere with a temperature ranging from 450° C. to 550° C. and a pressure intensity ranging from 40 Mpa to 60 Mpa for 3 hours to 5 hours, wherein the nano dispersion copper alloy comprises the following components in percentage by mass:

0.05 wt. % to 1.61 wt. % of $Al_2O_3$, 0.008 wt. % to 0.012 wt. % of Ca, 0.008 wt. % to 0.012 wt. % of La, and the balance of Cu.

2. The brief manufacturing process of the nano dispersion copper alloy according to claim 1, wherein the internal oxidation method for preparing the Cu-$Al_2O_3$ alloy powder comprises the steps of:

first step: powder preparation smelting Al and Cu to prepare a Cu—Al alloy melt with an Al content of 0.03 wt. % to 0.8 wt. %, and atomizing the melt to prepare powder;

second step: ball-milling activation mixing the powder prepared in the first step with an oxidant for ball-milling activation;

third step: graded internal oxidation performing two-grade internal oxidation on the mixture obtained in the second step at 380° C. to 400° C. and 880° C. to 900° C. in a protective atmosphere; and fourth step: reduction crushing the internally oxidized powder obtained in the third step and then reducing with hydrogen to obtain the Cu-$Al_2O_3$ alloy powder.

3. The brief manufacturing process of the nano dispersion copper alloy according to claim 2, wherein in the first step, a smelting temperature of the alloy is 1200° C. to 1230° C.; and the alloy melt is pulverized by pure nitrogen atomization, and a purity of nitrogen is more than or equal to 99.9%.

4. The brief manufacturing process of the nano dispersion copper alloy according to claim 2, wherein in the second step, alloy powder with a particle diameter less than 40 meshes is mixed with the oxidant for ball-milling activation; an addition amount of the oxidant accounts for 0.5 wt % to 9.5 wt % of a mass of the alloy powder; and the ball-milling activation is performed under the conditions of: a ratio of ball and material is 3:1 to 10:1, a rotating speed is 50 rpm to 300 rpm, a ball milling time is 120 minutes to 600 minutes, and an atmosphere is air.

5. The brief manufacturing process of the nano dispersion copper alloy according to claim 2, wherein in the third step, parameters of the internal oxidation process are as follows: a ball-milled powder is heated to 380° C. to 400° C. in an argon or nitrogen atmosphere and held for 2 hours to 4 hours, and then the ball-milled power is continuously heated to 880° C. to 900° C. and held for 2 hours to 4 hours.

6. The brief manufacturing process of the nano dispersion copper alloy according to claim 2, wherein in the fourth step, the internally oxidized powder is sieved through a 40-mesh sieve after crushing, and the sieved powder is heated to 880° C. to 900° C. and reduced by hydrogen for 4 hours to 8 hours.

7. The brief manufacturing process of the nano dispersion copper alloy according to claim 1, wherein the preparation method of the Cu—Ca—La alloy powder comprises the following steps of: heating and smelting Cu, Cu—Ca intermediate alloy and La to prepare a Cu—Ca—La alloy melt with a Ca content of 0.08 wt. % to 0.12 wt. % and a La content of 0.08 wt. % to 0.12 wt. %; atomizing the melt with high-purity nitrogen to prepare powder; sieving the powder with a 200-mesh sieve; and performing ball-milling on the sieved powder until a particle diameter of the powder is less than 20 microns to obtain superfine powder; wherein a purity of the high-purity nitrogen is more than or equal to 99.9%.

8. The brief manufacturing process of the nano dispersion copper alloy according to claim 1, wherein the Cu—Ca—La alloy powder and the Cu—Al alloy powder prepared by the internal oxidation method are mixed according to a mass ratio ranging from 1:10 to 1:15, subjected to cold isostatic pressing, sheathed by pure copper in an argon chamber, subjected to water sealing and hot extrusion at 900° C. to 920° C., with an extrusion ratio greater than or equal to 15, then subjected to rotary forging after extrusion; a rotationally forged bar is placed in a new sheath, then the sheath is vacuumized to $10^{-3}$ Pa, sealed, and placed in a nitrogen atmosphere with a pressure intensity ranging from 40 Mpa to 60 Mpa at 450° C. to 550° C. for 3 hours to 5 hours.

9. The brief manufacturing process of the nano dispersion copper alloy according claim 8, wherein the prepared nano dispersion copper alloy has a tensile strength of 330 MPa to 580 MPa at room temperature, an electric conductivity greater than 80% to 97% of IACS, a free oxygen content less than or equal to 15 ppm, and an air leakage rate less than or equal to $1.0\times10^{-10}$ Pa $m^3/s$.

10. The brief manufacturing process of the nano dispersion copper alloy according claim 8, wherein the diameter of prepared nano dispersion copper alloy of φ20 mm is changed by 0.00 μm before and after annealing with hydrogen at 900° C. for 1 hour through measurement by a spiral micrometer.

* * * * *